US006185888B1

(12) United States Patent
Wasson

(10) Patent No.: US 6,185,888 B1
(45) Date of Patent: Feb. 13, 2001

(54) POST

(76) Inventor: Charles T. Wasson, 722 Ekastown Rd., Sarver, PA (US) 16055

( * ) Notice: Under 35 U.S.C. 154(b), the term of this patent shall be extended for 0 days.

(21) Appl. No.: 09/130,233

(22) Filed: Aug. 6, 1998

(51) Int. Cl.[7] ..... E04H 12/12

(52) U.S. Cl. ..... 52/300; 52/28; 52/503; 52/606; 52/745.18; 52/747.12; 52/DIG. 7; 256/19; 362/152

(58) Field of Search ..... 52/28, 98, 100, 52/103, 104, 220.2, 220.8, 300, 301, 503, 504, 576, 589.1, 590.3, 604, 606, 745.18, 745.2, 747.12, DIG. 7; 249/63, 142, 143, 175; 232/38, 39; 256/1, 19; 264/31; 362/152

(56) References Cited

U.S. PATENT DOCUMENTS

| | | | | |
|---|---|---|---|---|
| 16,486 | * | 1/1857 | Johnson | 256/19 |
| 130,843 | * | 8/1872 | Butler | 249/175 |
| 757,093 | * | 4/1904 | Coltrin | 249/169 |
| 1,524,146 | * | 1/1925 | Murray | 52/300 X |
| 2,541,460 | * | 2/1951 | Bugh | 52/301 X |
| 3,298,668 | * | 1/1967 | Schueren | 52/300 X |
| 3,447,786 | * | 6/1969 | Bigni | 256/13.1 |
| 4,041,660 | * | 8/1977 | Yensen | 52/589.1 X |
| 4,422,269 | * | 12/1983 | Giard | 52/301 X |
| 5,501,057 | * | 3/1996 | Dawson | 52/300 X |
| 5,836,572 | * | 11/1998 | Sugiyama | 256/19 |
| 5,934,035 | * | 8/1999 | Rasmussen et al. | 52/300 |

* cited by examiner

*Primary Examiner*—Carl D. Friedman
*Assistant Examiner*—Kevin D. Wilkens
(74) *Attorney, Agent, or Firm*—Ansel M. Schwartz

(57) ABSTRACT

A post. The post includes a rigid support structure. The post includes a plurality of pieces. Each piece has a hole extending through it so the piece can fit into the support structure and remain in place on the support structure. Each piece is stackable upon another piece. A method for installing a post. The method includes the steps of placing a rigid support structure on ground. Then there is the step of aligning a hole of a piece over the support structure. Next there is the step of moving the piece down onto the ground so the support structure extends through the hole and the support structure maintains the piece in place. Then there is the step of aligning a hole of another piece over the support structure. Next there is the step of moving the other piece down onto the piece so the support structure extends through the hole of the other piece and the support structure maintains the piece in place. A method of forming a stone for a post. The method includes the steps of forming a mold which defines a land in the mold's center. Then there is the step of placing liquid stone in the mold. Next there is the step of letting the liquid stone harden. Then there is the step of separating the stone from the mold so a hole exists through the stone due to the presence of the land in the mold.

14 Claims, 4 Drawing Sheets

POST

FIELD OF THE INVENTION

The present invention is related to a post. More specifically, the present invention is related to a post made of pieces which are stackable on top of each other and removable to form a post in another location.

BACKGROUND OF THE INVENTION

Posts are a common sight in a yard or field. The post many times serves both as an architecturally aesthetically pleasing fixture and a functional support for such items as a mailbox, gate, sign, fence or other similar feature. However, the problem with many posts are that they are not self standing and/or require cement or grout to hold the rock or stone in place to form the post. Besides taking time, skill and money to cement the rock or stone together, it causes the post to become a permanent fixture, only able to be removed by being destroyed.

The present invention provides for a post that can be easily and quickly properly constructed, as desired, and subsequently broken down and rebuilt again at another location without any damage to the post.

SUMMARY OF THE INVENTION

The present invention pertains to a post. The post comprises a rigid support structure. The post comprises a plurality of pieces. Each piece has a hole extending through it so the piece can fit into the support structure and remain in place on the support structure. Each piece is stackable upon another piece.

The present invention pertains to a method for installing a post. The method comprises the steps of placing a rigid support structure on ground. Then there is the step of aligning a hole of a piece over the support structure. Next there is the step of moving the piece down onto the ground so the support structure extends through the hole and the support structure maintains the piece in place. Then there is the step of aligning a hole of another piece over the support structure. Next there is the step of moving the other piece down onto the piece so the support structure extends through the hole of the other piece and the support structure maintains the piece in place.

The present invention pertains to a method of forming a stone for a post. The method comprises the steps of forming a mold which defines a land in the mold's center. Then there is the step of placing liquid stone in the mold. Next there is the step of letting the liquid stone harden. Then there is the step of separating the stone from the mold so a hole exists through the stone due to the presence of the land in the mold.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
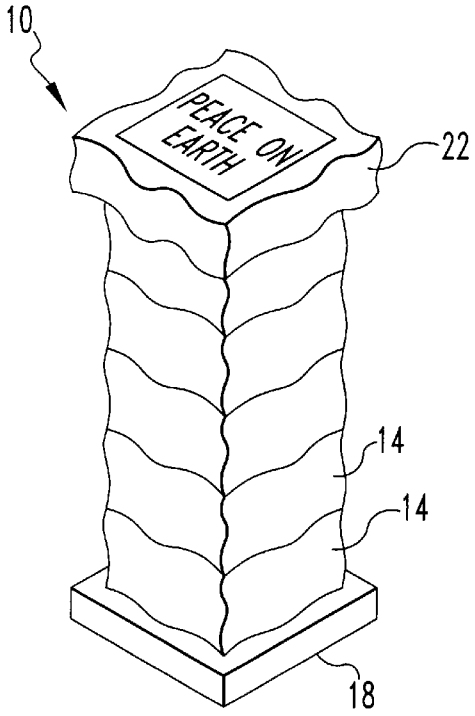
FIG. 1 is a schematic representation of a post of the present invention.
Figure 2:
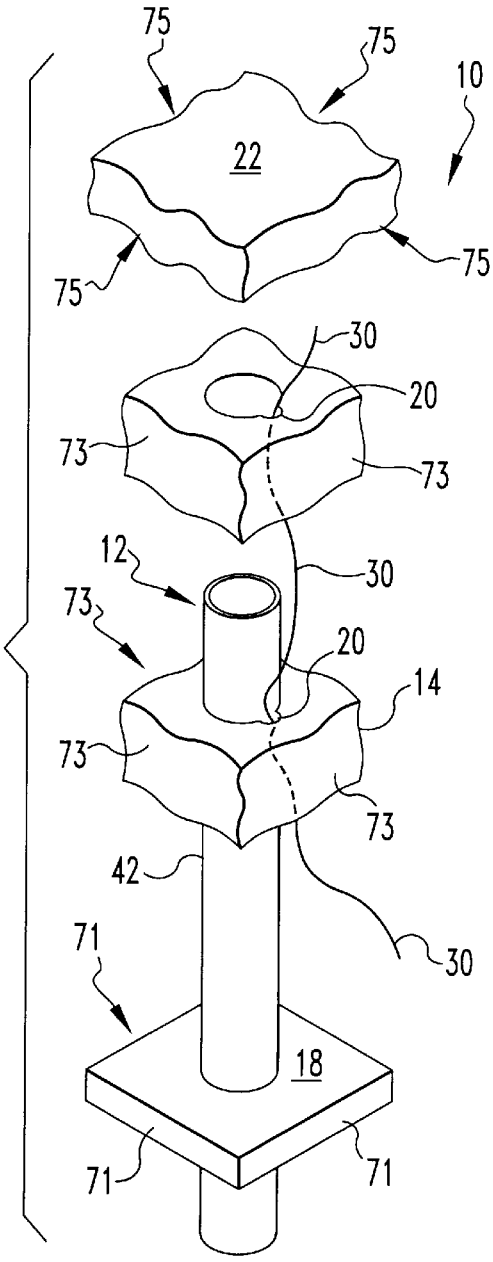
FIG. 2 is a schematic representation of an exploded view of the post.

Referring now to the drawings wherein like reference numerals refer to similar or identical parts throughout the several views, and more specifically to FIGS. 1 and 2 thereof, there is shown a post 10. The post 10 comprises a rigid support structure 12. The post 10 comprises a plurality of pieces 14. Each piece 14 has a hole 16 extending through it so the piece 14 can fit into the support structure 12 and remain in place on the support structure 12. Each piece 14 is stackable upon another piece 14.

Preferably, the post 10 includes a base 18 to which the rigid support structure 12 is fixed and from which the support structure 12 extends. The pieces 14 are preferably of a predefined shape. Preferably, the pieces 14 are separable from each other and from the support structure 12 after they are placed on each other and the support structure 12.

Figure 3:
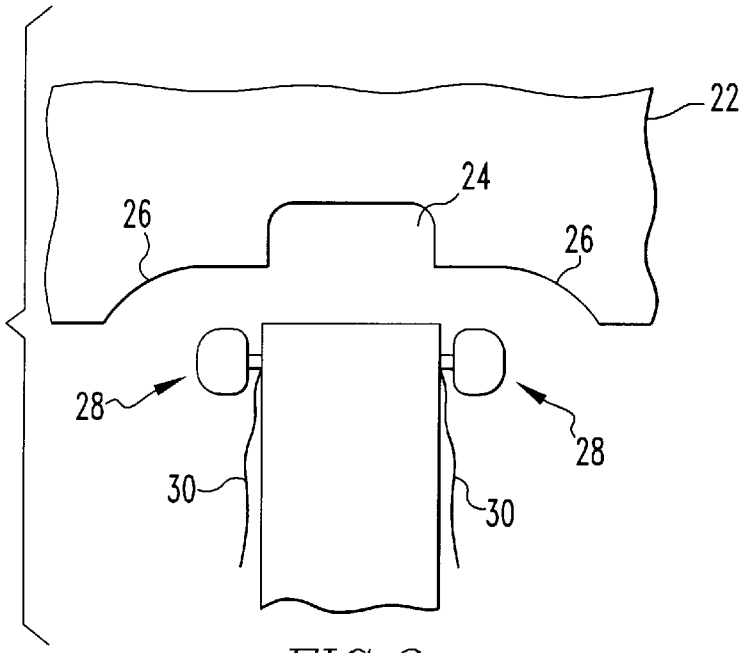
FIG. 3 is a schematic representation of lights extending from a shaft, and a cap piece.

The post 10 preferably includes a cap piece 22 which fits on top of the pieces 14 and on the support structure 12. Preferably, the cap piece 22 has a well 24 which fits with the top of the support structure 12 to hold the cap piece 22 in place, as shown in FIG. 3.

Figure 5:
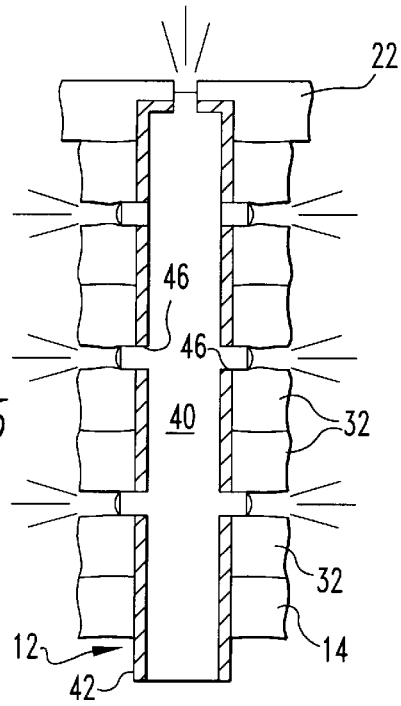
FIG. 5 is a schematic representation of a side cross-sectional view of a post with a pipe and fence pieces.

Each piece 14 preferably has a keyway 20 which extends through it. Preferably, a keyway 20 is connected to a hole 16. The cap piece 22 preferably has an indentation 26 which aligns with a keyway 20 of a piece 14 upon which the cap piece 22 is placed. Preferably, the post 10 includes a light 28 disposed in the indentation 26, and electrical wiring 30 extending through the keyway 20 and connecting to the light 28. Preferably, the post 10 includes a pipe 40 which extends through the support structure 12 which carries fluid, as shown in FIG. 5.

Figure 4:
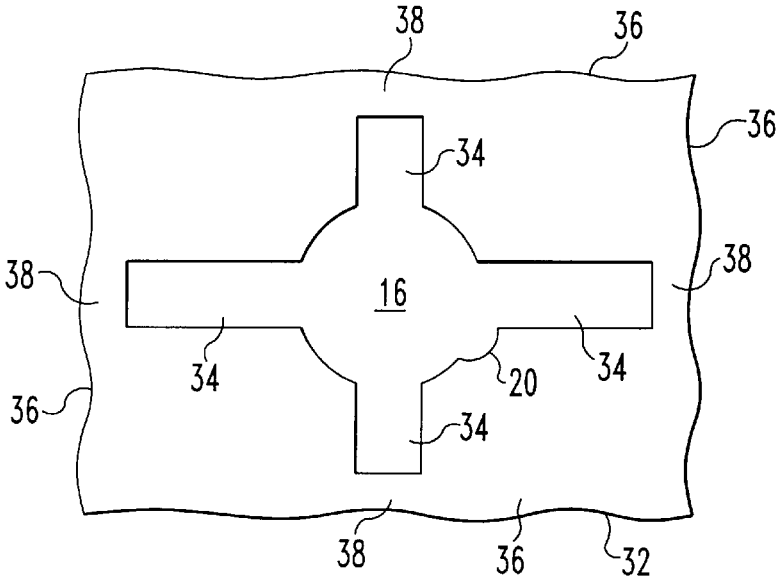
FIG. 4 is a schematic representation of a bottom cut away view of a fence piece.
Figure 6:
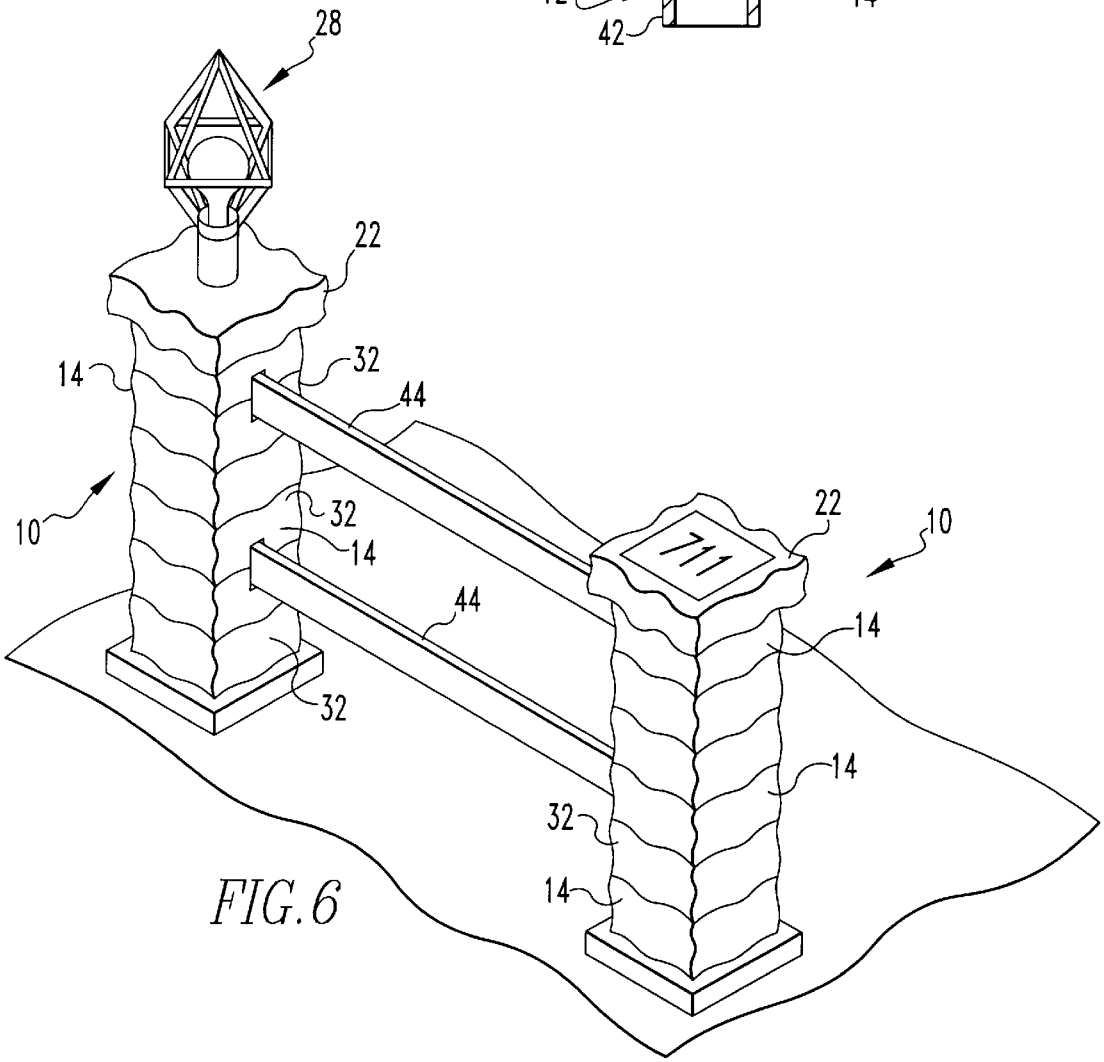
FIG. 6 is a schematic representation of a perspective view of posts connected by a fence post.
Figure 7:
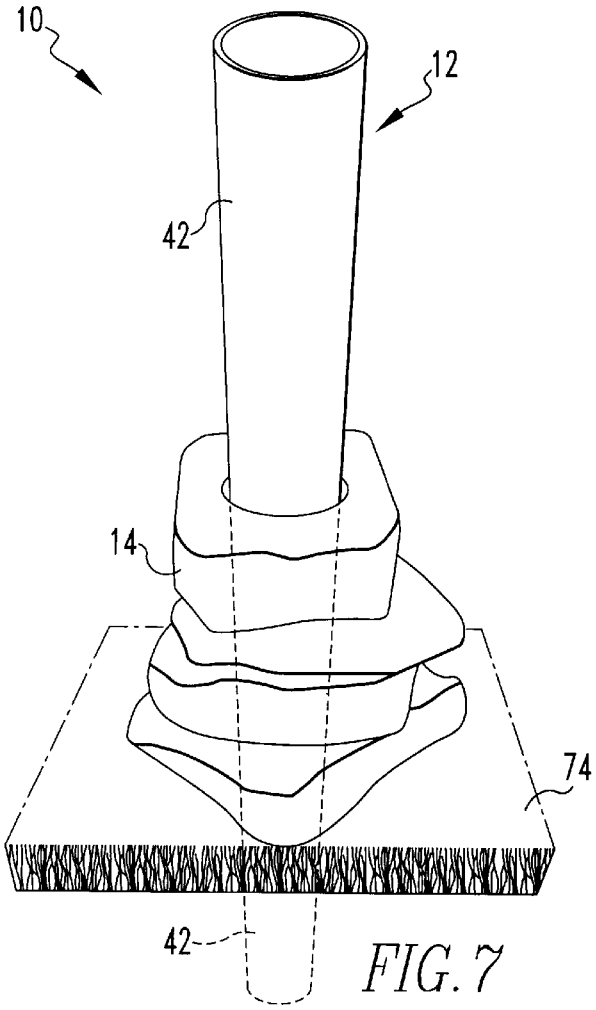
FIG. 7 is a schematic representation of a post of the present invention.

The pieces 14 preferably include a fence piece 32 having at least one tunnel 34 in a side 36 which is adapted to receive and hold a fence rail 44, as shown in FIGS. 4 and 6. Preferably, the fence piece 32 includes one tunnel 34 in each side 36. In front of each tunnel 34 in each side 36 is preferably a side 36 wall skin 38 which maintains the integrity and closure of the side 36 and which is breakable to expose the respective tunnel 34 so a fence rail 44 can be inserted into the tunnel 34.

The support structure 12 preferably includes a shaft 42. Preferably, the shaft 42 is made of plastic, metal or wood. The pieces 14 are preferably made of stone. Preferably, the pieces 14 are rectangular or round. Each stone preferably weighs between 515 pounds.

The present invention pertains to a method for installing a post 10. The method comprises the steps of placing a rigid support structure 12 on ground. Then there is the step of aligning a hole 16 of a piece 14 over the support structure 12. Next there is the step of moving the piece 14 down onto the ground so the support structure 12 extends through the hole 16 and the support structure 12 maintains the piece 14 in place. Then there is the step of aligning a hole 16 of another piece 14 over the support structure 12. Next there is the step of moving the other piece 14 down onto the piece 14 so the support structure 12 extends through the hole 16 of the other piece 14 and the support structure 12 maintains the other piece 14 in place.

Preferably, after the second moving step there is the step of placing a cap piece 22 on top of the support structure 12.

After the step of placing the cap piece 22 there is preferably the step of moving the post 10 by lifting the cap piece 22, piece 14 and other piece 14 off of the support structure 12; moving the support structure 12 to another location; and stacking the piece 14, the other piece 14 and cap piece 22 on top of each other and the support structure 12. Preferably, after the second moving step there is the step of inserting a fence rail 44 into a tunnel 34 of a fence piece 32.

After the second moving step there is preferably the step of extending electrical wiring 30 through a keyway 20 of each piece 14. The placing the cap piece 22 step preferably then includes the step of connecting the wiring 30 to a light 28 in an indentation 26 of the cap piece 22.

The present invention pertains to a method of forming a stone for a post 10. The method comprises the steps of forming a mold which defines a land in the mold's center. Then there is the step of placing liquid stone in the mold. Next there is the step of letting the liquid stone harden. Then there is the step of separating the stone from the mold so a hole 16 exists through the stone due to the presence of the land in the mold.

In the operation of the preferred embodiment and as shown in FIGS. 1 and 2, a post 10 is chosen to be placed at a predetermined location. The post 10 is built by first placing a base 18 having a hollow round shaft 42 made of PVC tube extending from it at the predetermined location. The base 18 is rectangular and extends on all sides 71 beyond the diameter of the shaft 42 to preclude or minimize the shaft 42 from tipping over, and instead providing further support for the shaft 42. Alternatively, the shaft 42 can be sunk into the ground.

Pieces 14, made of stone and weighing about ten pounds apiece are stacked along the shaft 42. Each piece 14 has a hole 16 extending through its center and a keyway 20 connected to the hole 16. Each piece's hole 16 is aligned with the shaft 42 and then slid down the shaft 42 until it contacts the base 18, if it is the first piece placed on the shaft 42, or the piece 14 that was previously placed on the shaft 42. In this way the pieces 14 are stacked on top of each other, with the shaft 42 preventing them from falling off, due to the shaft 42 extending through the hole 16 in the center of the piece 14 and holding them in place.

When lighting is desired to be present in the post 10, as the first piece is placed along the shaft 42 to the base 18, wiring 30 is fitted into the keyway 20 that is disposed alongside the shaft 42 which now is in the hole 16 of the piece 14. As each piece 14 is in turn brought down along the shaft 42 through its hole 16 and stacked on the previous piece 14, the wiring 30 is extended through the keyway 20 of the piece 14 and threaded up through the post 10 along the interior keyway 20 that is connected to the hole 16 of each piece 14.

When the pieces 14 are stacked almost to the top of the shaft 42, a cap piece 22 having a well 24 in its bottom, instead of a hole 16 through the cap piece 22, is placed on the top of the shaft 42 in the well 24. The cap piece 22, by not having a hole 16, only a well 24, fixed on to the shaft 42, serves to close off sides 75 of the cap piece 22 post 10 with the appearance of stone along the sides 73 of pieces 14 and the top of the post 10.

When the cap piece 22 is placed on top of the shaft 42, lights 28, which fit in indentations 26 connected to the well 24 of the cap piece 22, as shown in FIG. 3, are connected to wiring 30 that extend up through the keyway 20 of the top most piece 14 upon which the cap piece 22 is being placed when it is fitted on the shaft 42. The wiring 30 provides electricity to the lights 28 in the indentations 26. The indentations 26 serve also to reflect light 28 downward from the cap piece 22 about the post 10, illuminating the post 10 and the ground about the post 10, and serving to protect and hide the lights 28.

When the post 10 is desired to be used to support a fence rail 44, then instead of only pieces 14 being stacked on the shaft 42, interspersed with the pieces 14 are fence pieces 32. The fence pieces 32 have tunnels 34 that extend from the hole 16 in each side 36. The tunnels 34 stop at a skin 38. The skin 38 serves to make it appear that the piece 14 from the outside 36 is solid and continuous. When the desired tunnel 34 is picked to receive a fence rail 44, the skin 38 protecting the tunnel 34 is chipped or broken away, since it is relatively thin and breakable by the simple chiseling or pounding with a hammer, causing the tunnel 34 to be exposed. A fence rail 44 is then inserted into the tunnel 34 and held by the tunnel 34 in place. The post 10 by holding the fence rail 44 in the tunnel 34, supports the fence rail 44 and the fence. Typically two or three fence pieces 32 are used, depending on the height of the fence to provide proper support for the fence.

For further aesthetically pleasing value, a cap piece 22 can have its well 24 chiseled through to create a hole 16, and/or, shaft holes 46 can be formed in the shaft 42 in connection with pipes 40, which in turn can have their skins 38 removed so the tunnels 34 are exposed to the outside. At these points in the tunnel 34 or at the top of the cap piece 22 which has its well 24 chiseled through, pipes 40 carrying fluid can be connected to create a fountain or waterfall effect. The pipes 40 can be connected to a fluid source such as water, as is well known in the art. Alternatively, if so desired, fiber optics can be strung through the keyway 20 and extended out the post 10 at predesired points to create a lighting effect using optical fibers, as is well known in the art.

Figure 8:
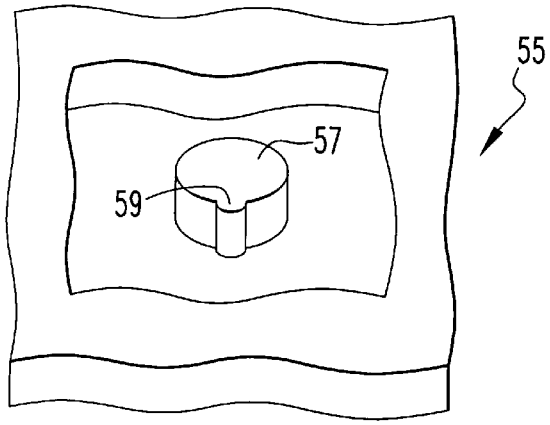
FIG. 8 is a schematic representation of a mold.

Each individual piece 14 is formed in a mold 55, as shown in FIG. 8. The mold 55 has a land 57 in its center with a side land 59 that defines a keyway 20, while the land defines a hole 16 in the piece 14 when it is formed. The mold 55 is filled with liquid stone of any desired color. The mold 55 can be of any desired shape although typically rectangular, squarish or roundish with some roughening on the sides 73 of pieces 14 to create a natural rock like look can be formed in the mold 55. After the liquid stone is poured into the mold 55, it is allowed to harden and is then separated from the mold 55 to form a piece 14.

The dimensions of the post 10 and its elements can vary as desired for the specific application and use. The stones that are made from the pieces 14 can be of any weight and size desired. In one example, the length and width of the piece can be 10 inches and its height can be 4 inches. The well can be 4.25 inches in diameter and 3.5 inches deep. The well goes to within 0.5 inches of the top of the piece. The diameter of the indentations, from one edge to the other edge is 9 inches, which also defines the radius of curvature to form the indentations. The depth of an indentation at its greatest point just before the hole begins is 2 inches. The tunnels can be 1.5 inches wide and 2 inches deep. The shaft 42 can be inserted into ground 74 a depth of 18 inches. The shaft 42 can be cut to the desired length.

The post can be used to hold mailboxes, lamps, lights, gates, signs, monuments, etc.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A post comprising:

a rigid support structure;

a plurality of pieces, each piece having a hole extending through it so the piece fits onto the support structure and remain in place on the support structure, each piece stacked upon another piece, the pieces are of a predefined shape, the pieces are separable from each other and from the support structure after they are placed on each other and the support structure, each piece has a keyway which extends through it, the keyway is connected to the hole;

a base to which the rigid support structure is fixed and from which the support structure extends; and a cap piece which fits on top of the pieces and on the support structure the cap piece has a well which fits with the top of the support structure to hold the cap piece in place and the cap piece has an indentation which aligns with a keyway of a piece upon which the cap piece is disposed.

2. A post as described in claim 1 including a light disposed in the indentation, and electrical wiring extending through the keyway and connecting to the light.

3. A post as described in claim 2 wherein the pieces include a fence piece having at least one tunnel and a side which is adapted to receive and hold a fence rail.

4. A post as described in claim 3 wherein the fence piece includes one tunnel in each side.

5. A post as described in claim 4 wherein in front of each tunnel in each side is a side wall skin which maintains the integrity and closure of the side and which is breakable to expose the respective tunnel so a fence rail can be inserted into the tunnel.

6. A post as described in claim 5 including a pipe which extends through the support structure which carries fluid.

7. A post as described in claim 6 wherein the support structure includes a shaft.

8. A post as described in claim 7 wherein the shaft is made of plastic, metal or wood.

9. A post as described in claim 8 wherein the pieces are rectangular or round.

10. A post as described in claim 9 wherein each piece weighs between 5–15 pounds.

11. A method for installing a post comprising the steps of:

placing a rigid support structure on ground;

aligning a hole of a first piece over the support structure;

moving the first piece down onto the ground so the support structure extends through the hole and the support structure maintains the first piece in place;

aligning a hole of a second piece over the support structure;

moving the second piece down onto the first piece so the support structure extends through the hole of the second piece and the support structure maintains the piece in place; and placing a cap piece on top of the support structure so an indentation in the bottom surface of the cap piece aligns with a keyway on the second piece.

12. A method as described in claim 11 including after the step of placing the cap piece there is the step of moving the post by lifting the cap piece, first piece and second piece off of the support structure, moving the support structure to another location, and stacking the first piece, the second piece and cap piece on top of each other and the support structure.

13. A method as described in claim 22 including after the step of moving the second piece, there is the step of inserting a fence rail into a tunnel of the second piece.

14. A method as described in claim 13 including after the moving the second piece, there is the step of extending electrical wiring through a keyway of the first piece and the keyway of the second piece, and the placing the cap piece step includes the step of connecting the wiring to a light in the indentation of the cap piece.

* * * * *